United States Patent [19]

Sumansky

[11] Patent Number: 4,509,989

[45] Date of Patent: Apr. 9, 1985

[54] CLEANING METHOD FOR REMOVING SULFUR CONTAINING DEPOSITS FROM COKE OVEN GAS LINES

[75] Inventor: L. Walter Sumansky, South Park Township, Allegheny County, Pa.

[73] Assignee: United States Steel Corporation, Pittsburgh, Pa.

[21] Appl. No.: 478,951

[22] Filed: Mar. 25, 1983

[51] Int. Cl.[3] ..... B08B 9/02; C11D 3/30

[52] U.S. Cl. ..... 134/22.12; 134/2; 134/22.14; 252/8.55 B; 252/82; 252/87; 252/102; 252/548

[58] Field of Search ..... 134/2, 22.14, 22.12, 134/40; 252/102, 105, 548, 81, 82, 87, 8.55 B

[56] References Cited

U.S. PATENT DOCUMENTS

| | | | |
|---|---|---|---|
| 1,935,217 | 11/1933 | Ulrich et al. | 87/5 |
| 2,393,865 | 1/1946 | Wassell | 252/105 |
| 3,227,655 | 1/1966 | Prett et al. | 252/186 |
| 3,331,657 | 7/1967 | Peter et al. | 23/3 |
| 3,476,599 | 11/1969 | Grover et al. | 134/4 |
| 3,663,445 | 5/1972 | Augustin et al. | 252/548 |
| 3,740,267 | 6/1973 | Haylock | 134/10 |
| 3,806,460 | 4/1974 | Mukai | 134/40 |
| 3,846,311 | 11/1974 | Sharp et al. | 252/8.55 B |
| 3,909,422 | 9/1975 | Sample, Jr. | 252/8.55 B |
| 4,000,082 | 12/1976 | Otrhalek et al. | 134/40 |
| 4,011,882 | 3/1977 | Nivens et al. | 134/22.14 |
| 4,135,947 | 1/1979 | Rink | 134/4 |
| 4,194,524 | 3/1980 | Wicke | 137/24 |
| 4,222,886 | 9/1980 | Connelly, Jr. | 252/149 |
| 4,230,587 | 10/1980 | Walker | 252/8.55 R |

OTHER PUBLICATIONS

Hackh's Chemical Dictionary, 4th edition, 1969, McGraw Hill, p. 625.

Chemical Abstracts, vol. 80, 1974, No. 110540.

Chemical Abstracts, vol. 97, 1982, No. 219355.

*Primary Examiner*—S. Leon Bashore

*Assistant Examiner*—K. M. Hastings

*Attorney, Agent, or Firm*—W. Gary Goodson

[57] ABSTRACT

Process for removing hard to remove deposits containing elemental sulfur and multivalent compounds from a surface comprising (1) contacting the deposits with a cleaning composition comprising (a) a major portion of aliphatic amine, (b) water, and (c) an oxidizing or reducing agent, (2) allowing the cleaning composition to remain in contact with the deposits for sufficient time to allow sufficient dissolution of said solid to take place to allow removal of the deposits to take place, and (3) applying such force as is necessary to remove these partially dissolved deposits from the surface. A preferred cleaning composition comprises (1) from about 60 to about 90 volume percent aliphatic amine, (2) from about 10 to about 40 volume percent water, and (3) from about 1 to about 3 weight percent of a moderate oxidizing or reducing agent, such percentages based on the total composition.

16 Claims, No Drawings

CLEANING METHOD FOR REMOVING SULFUR CONTAINING DEPOSITS FROM COKE OVEN GAS LINES

FIELD OF THE INVENTION

This invention relates to a method of removing elemental sulfur containing deposits from surfaces, and a cleaning composition therefor.

BACKGROUND OF THE INVENTION

In the conveyance of gases from coal conversion processes, e.g. coke oven gas, through gas lines, deposits are formed which tend to fall out in places such as valves, constrictions or places where change of direction of flow occurs. Whenever sufficient buildup occurs, a valve cannot be opened or shut and so becomes useless. It must then be removed and cleaned. In many cases, the valve cannot be used for any control function whatever and cannot be shut off for any reason even an emergency.

Other facilities such as small metering devices, pipelines, etc. also get plugged or flow restricted because of these deposits.

While much of the discussion which follows talks about coke oven gases, it will be understood that the invention described herein applies equally well to other gases having similar characteristics, and particularly to gases derived from coal conversion processes.

Prior to the installation of certain gas cleaning and separation processes, the downstream gas lines were cleaned by mechanical means. A mechanical cleaning device, called a "pig", was sent through the downstream gas lines. Generally, the material which was pushed out was tarry in nature and no doubt acted as a lubricant for the mechanical "pig". With the introduction of the gas cleaning and separation processes, tar could no longer pass in the downstream gas lines as all of the intervening steps resulted in a tar free gas. Concurrently, the gas became drier and cleaner because of the process. However, certain reactions continued to occur in the gas mains and in the underfiring system resulting in deposits being formed in various sections of the pipeline.

As time progressed, significant buildup of deposits in the down-river gas mains were found. The deposits caused flow restriction, were corrosive and resulted in additional weight on support structures. On several occasions it was necessary to cut the lines open, remove the deposits by drag-bucket or high pressure water blast means and reseal the lines by adding slipjoints or rewelding.

Efforts to solve the problem by using various solvents were essentially unsuccessful. In one case, for example, a commercial solvent was applied to a valve stem of a coke oven gas line plugged with such deposits, fifty days or longer were required before any movement of the valve stem could be noticed.

The deposits removed from the lines were in many instances relatively dry. Some areas were more dry than others in that the condensation of water and other condensables was a function of the distance from the coke plant and the ambient temperature.

It was found that certain reactions between hydrogen sulfide, hydrogen cyanide, ammonia, water and iron in the pipeline were occurring, resulting in the formation of solid deposits. These reactions also occur in the underfiring system lines feeding the coke batteries. Material removed from the underfiring gas valves was found to be very similar to the deposits found in the downstream lines. The deposits were found to contain elemental sulfur, and multivalent compounds, such as iron in different valence states.

The infrequent need to open and close valves in the underfiring lines, in all probability, permitted the buildup of deposits without being noticed. The deposition became such that it resulted in the inability to move the valve in either direction. The consequences of not being able to open or close a valve can be serious, resulting in the loss of ability to regulate or shut off gas flow.

SUMMARY OF THE INVENTION

Process for removing hard to remove deposits containing elemental sulfur and multivalent compounds from a surface comprising (1) contacting said deposits with a cleaning composition comprising (a) a major portion of aliphatic amine capable of dissolving the elemental sulfur in the presence of water, (b) water in sufficient quantities to dissolve said multivalent compounds, and (c) sufficient oxidizing or reducing agent to change the valence of the multivalent compounds to a more uniform valent state to thereby be more readily dissolved by said water, (2) allowing said cleaning composition to remain in contact with said deposits for sufficient time to allow sufficient dissolution of said solid to take place to allow removal of said deposits to take place, and (3) applying such force as is necessary to remove these partially dissolved deposits from the surface.

Preferably the process is carried out using a cleaning composition comprising (1) from about 60 to about 90 volume percent aliphatic amine, (2) from about 10 to about 40 volume percent water, and (3) from about 1 to about 3 weight percent of a moderate oxidizing or reducing agent, such percentages based on the total composition.

The development of the method of this invention has resulted in the ability of injecting the cleaning composition of this invention into the bonnets of large valves and having them become operable in less than 24 hours. The ability to clean these valves and having them functional permits the control of gas flow and results in safe and effective gas control.

The time period for allowing the cleaning composition to remain in contact with the deposits after the contacting step is preferably at least about 8 hours, and more preferably between about 16 hours and about 24 hours.

The amount of cleaning composition applied to the deposits is between about 2 and about 8 gallons of said cleaning composition for each 1 to 2 inch thickness of said deposits per square foot of area.

The temperature of the cleaning composition of this invention is preferably maintained above freezing and below such temperature that substantial vaporization of said amine takes place. Such temperature is preferably between about 50° F. and about 70° F.

PREFERRED EMBODIMENTS

The aliphatic amine is preferably monoethanol amine, diethanol amine, triethanol amine, or diisopropanol amine. The moderate oxidizing agent or reducing agent is preferably a water soluble hypochlorite, hypobromite, or a salt of hydroxylamine such as a chloride or sulfate, stannous chloride or benzoyl peroxide.

Preferably the cleaning composition is first injected onto the deposits to be removed, and then the deposits are flushed off from the surface with a suitable liquid.

Preferably the process is repeated in order to substantially completely remove the deposits from the surface. In a preferred process the deposits are contacted with the cleaning composition of this invention by spraying the cleaning composition onto the deposits over a period of time of at least two hours, the spraying being with such force to assist in the dissolving action. More preferably the spraying is conducted as a fine, misty spray.

More preferably the spraying is conducted for a time period of between about 4 and about 10 hours, and even more preferably for a time period of between about 6 and about 8 hours.

A preferred cleaning composition according to this invention comprises (1) from about 70 to about 80 volume percent triethanol amine, and (2) from about 20 to about 30 volume percent water.

EXAMPLES 1 and 2

A commercial organic solvent made by Betz Co. was injected in a valve in a coke oven gas line which was frozen up with deposits containing elemental sulfur and multivalent iron compounds. The solvent was added at the rate of 8 gallons per day for 54 days before noticeable movement of the valve occurred. The solvent cost alone was over $3,000 using this commercial solvent.

A cleaning composition of the following composition was used according to the teachings of this invention:

3 gal. monoethanolamine,
1.8 gal. water,
1 lb. hydroxylamine sulfate is dissolved in the 1.8 gal. water.

The shut off valve treated with this composition for 16 hours and with five gallons of the material was operable.

EXAMPLES 3 and 4

A cleaning composition of the following composition is prepared:

3.5 gal. monoethanolamine,
1.4 gal. water,
1 lb. hydroxylamine sulfate is dissolved in the 1.4 gal. water.

Ten gallons of the chemical composition are injected into each valve—5 gallons each into both bonnet and gate. It is pumped at a rate of approximately 5 gpd. The pressure at the pad valve inlet is maintained at 20 to 25 psig, in order to keep the pump discharge pressure high enough above suction pressure for the pump to operate correctly. The injection is interrupted once or twice with a 20 to 30 second water flush to displace the matter from the valve track.

The injection into the bonnet at one coke battery pad valve began at 3:30 PM, but was discontinued within an hour due to calibration difficulties. At 9:30 the next morning the pump was restarted. The valve was flushed with water at 1:40 PM, and at 2:00 the valve could be turned by one man to within six inches of closing. The valve was not turned further than this in order not to interfere with battery operation. At this point only about one gallon of chemical had been pumped into the valve's bonnet. The injection continued until a total of 2 gallons of the cleaning composition had been injected. Then the fittings were moved to the valve's gate and the remainder of the 5-gallon can of chemical was injected.

After loosening this valve, it is not apparent whether the success was due to the chemical, the water flush or to organized manpower. Before injecting the amine to a second coke battery pad valve, unsuccessful attempts were made to open the valve using two men and a water flush.

The injection of the above cleaning composition into the bonnet of the second coke battery pad valve began at 11:00 AM. At 1:30 the following afternoon, after 5 gallons of solvent and one water flush, the valve could be moved by one man. Five more gallons were then pumped into the valve's gate.

EXAMPLE 5

A valve on No. 19 coke oven Battery controlling the inlet of gas could not be moved preparatory to shutdown of the unit. A blank is inserted between the valve and the connecting pipe. A small pump is used to feed the solution shown in "Examples 3 and 4" into an air atomizing nozzle. The nozzle is screwed into a bored hole in the bonnet and the solution is sprayed into the valve by atomization such that it covers the threads of the valve moving screw mechanism. After injection of the solution over an 8-hour period, the valve is flushed with normal city water. A second 8-hour solution injection period is used as the particular inoperable valve was not used for several years. A second flush of water is made. Immediately thereafter the valve can be turned and closed for gas shut-off.

As noted previously, the preferred method of injection is to atomize the solution into the area to be cleaned. Several treatments may be necessary for full response of the mechanism to be cleaned or opening a restriction.

I claim:

1. Process for removing from gas lines for handling coal conversion process gases having properties similar to coke oven gas, hard to remove deposits deposited from said gases, said deposits containing high elemental sulfur content and multivalent compounds comprising (1) contacting said deposits with a cleaning composition comprising (a) a major portion of aliphatic amine capable of dissolving said elemental sulfur in the presence of water, (b) water in sufficient quantities to dissolve said multivalent compounds, and (c) sufficient oxidizing or reducing agent to change the valence of said multivalent compounds to a more uniform valent state to thereby be more readily dissolved by said water, (2) allowing said cleaning composition to remain in contact with said deposits for sufficient time to allow sufficient dissolution of said deposits to take place to allow removal of said deposits to take place, and (3) applying such force as is necessary to remove these partially dissolved deposits from said surface.

2. Process as in claim 1 wherein said cleaning composition comprises (1) from about 60 to about 90 volume percent aliphatic amine, (2) from about 10 to about 40 volume percent water, and (3) from about 1 to about 3 weight percent of a moderate oxidizing or reducing agent, such percentages based on the total composition.

3. Process as in claim 2 wherein said aliphatic amine is monoethanol amine, diethanol amine, triethanol amine, or diisopropanol amine, and wherein said moderate oxidizing agent or reducing agent is a water soluble hypochlorite, hypobromite, or hydroxylamine hydrochloride, hydroxylamine sulfate, stannous chloride or benzoyl peroxide.

4. Process as in claim 3 wherein the surface being cleaned is a gas line valve, and wherein said cleaning composition is first injected into said valve and then said valve is flushed out with a suitable liquid.

5. Process as in claim 1 wherein said process is repeated in order to substantially completely remove said deposits from said surface.

6. Process as in claim 1 wherein said deposits are contacted with said cleaning composition by spraying said cleaning composition onto said deposits over a period of time of at least two hours, such spraying being with such force to assist in the dissolving action.

7. Process as in claim 6 wherein said spraying is conducted as a fine, misty spray.

8. Process as in claim 7 wherein said spraying is conducted for a time period of between about 4 and about 10 hours.

9. Process as in claim 8 wherein said spraying is conducted for a time period of between about 6 and about 8 hours.

10. Process as in claim 6 wherein the time period for allowing said cleaning composition to remain in contact with said deposits after the spraying step is at least about 8 hours.

11. Process as in claim 9 wherein the time period for allowing said cleaning composition to remain in contact with said deposits after the spraying step is between about 16 hours and about 24 hours.

12. Process as in claim 6 wherein the amount of cleaning composition applied to said deposits is between about 2 and about 8 gallons of said cleaning composition for each 1 to 2 inch thickness of said deposits per square foot of area.

13. Process as in claim 1 wherein the temperature of said cleaning composition is maintained above freezing and below such temperature that substantial vaporization of said amine takes place.

14. Process as in claim 13 wherein said temperature is between about 50° F. and about 70° F.

15. Process for removing hard to remove deposits in coke oven gas lines containing elemental sulfur and multivalent compounds from a metal surface comprising (1) contacting said deposits by spraying with a cleaning composition for a time period of between about 4 and about 10 hours, said composition comprising (a) a major portion of aliphatic amine capable of dissolving said elemental sulfur in the presence of water, (b) water in sufficient quantities to dissolve said multivalent compounds, and (c) sufficient oxidizing or reducing agent to change the valence of said multivalent compounds to a more uniform valent state to thereby be more readily dissolved by said water, (2) allowing said cleaning composition to remain in contact with said deposits for sufficient additional time after said spraying to allow sufficient dissolution of said deposits to take place to allow removal of said deposits to take place, (3) applying such force as is necessary to remove the partially dissolved deposits from said surface, and (4) repeating steps (1), (2) and (3) as necessary to obtain substantially complete removal of said deposits from said surface.

16. Process as in claim 15 wherein said deposits initially contain both di- and tri-valent iron.

* * * * *